US008640595B2

(12) United States Patent
Henker et al.

(10) Patent No.: US 8,640,595 B2
(45) Date of Patent: Feb. 4, 2014

(54) BLAST-RESISTANT VEHICLE HULL

(75) Inventors: Lyndon Scott Henker, Canton, MI (US); Edward F. Wettlaufer, St. Clair Shores, MI (US); Richard D. Cupka, Jr., Saline, MI (US); Dennis G. Slevin, Taylor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/593,603

(22) Filed: Aug. 24, 2012

(65) Prior Publication Data

US 2013/0205984 A1 Aug. 15, 2013

Related U.S. Application Data

(60) Provisional application No. 61/601,206, filed on Feb. 21, 2012, provisional application No. 61/598,517, filed on Feb. 14, 2012.

(51) Int. Cl.
*F41H 5/04* (2006.01)

(52) U.S. Cl.
USPC ..... 89/36.08; 89/36.09; 89/36.02

(58) Field of Classification Search
USPC ..... 89/36.02, 36.09, 36.08, 36.07
See application file for complete search history.

(56) References Cited

U.S. PATENT DOCUMENTS

| | | | | |
|---|---|---|---|---|
| 7,357,062 | B2 | 4/2008 | Joynt | |
| 8,033,208 | B2 | 10/2011 | Joynt et al. | |
| 8,047,117 | B1 | 11/2011 | Tan | |
| 8,387,511 | B2 * | 3/2013 | Johnson et al. | 89/36.08 |
| 2010/0275766 | A1 | 11/2010 | Joynt et al. | |
| 2011/0138994 | A1 | 6/2011 | Joynt et al. | |
| 2011/0148147 | A1 | 6/2011 | Tunis et al. | |
| 2011/0168001 | A1 | 7/2011 | Lee | |
| 2011/0277621 | A1 | 11/2011 | Joynt | |
| 2011/0314999 | A1 * | 12/2011 | Luther et al. | 89/36.02 |
| 2012/0180637 | A1 * | 7/2012 | Kocher | 89/36.08 |

OTHER PUBLICATIONS

James Capouellez, US Army RDECOM, Optimized Light Tactical Vehicle, U.S. Army Tank Automotive Research, Development and Engineering Center, Jul.-Sep. 2009.

* cited by examiner

*Primary Examiner* — J. Woodrow Eldred

(74) *Attorney, Agent, or Firm* — Brooks Kushman P.C.; Damian Porcari

(57) ABSTRACT

A vehicle hull has a longitudinal blast mitigation duct formed between left and right hull portions. The duct includes a first section oriented at a first angle to a longitudinal reference line, and a second section adjacent to the first section and oriented at a second angle to the reference line. The second angle is greater than the first angle to form a diverging surface for a shock wave travelling from the first to the second section. The blast mitigation duct further comprises a second, rearward-oriented diverging surface for a shock wave travelling rearward along the hull. A rib projects generally perpendicular from a joint between the first and second sections and is configured to initiate separation of the shock wave from the hull, thereby reducing the amount of energy transferred to the hull.

17 Claims, 9 Drawing Sheets

Prior Art

BLAST-RESISTANT VEHICLE HULL

CROSS-REFERENCE TO RELATED APPLICATIONS

This application claims the benefit of U.S. Provisional Application Nos. 61/598,517 filed Feb. 14, 2012, and 61/601,206 filed Feb. 21, 2012, the disclosures of which are incorporated in their entirety by reference herein.

TECHNICAL FIELD

The disclosure relates to vehicles, such as military vehicles, that may be subjected to blasts originating beneath or closely adjacent to the vehicle. More specifically, the disclosure relates to a vehicle hull geometry and method of construction providing improved protection from such blasts.

BACKGROUND

Military vehicles used in combat zones must provide ballistic and blast protection for occupants of the vehicle's crew compartment. One of the challenges in designing a military vehicle is to achieve the proper balance between crew protection (survivability) and mobility.

Good mobility generally calls for a vehicle to be lightweight and to have a relatively low center-of-gravity. To achieve a low center-of-gravity, the vehicle should sit as low to the ground as possible while still providing required ground clearance.

Survivability, on the other hand, drives vehicle design towards more armor, resulting in more weight and therefore a higher center-of-gravity. One way to improve survivability versus a detonation originating close to or below the crew compartment (such as detonation of a lane mine or IED) is to increase the clearance between the bottom of the crew compartment and ground. Increased armor weight and greater ground clearance may result in the vehicle center-of-gravity being so high as to cause an unacceptable roll-over risk when travelling over uneven terrain.

Improved vehicle survivability has recently been demonstrated by what is referred to as a Double-V hull configuration, the general concept of which is shown in FIGS. 1*a* and 1*b*. In the Double-V configuration, sloping or angled outward-facing surfaces extending along both sides of the lower portion of the vehicle hull form the first "V" (when viewed from the front or rear of the vehicle, FIG. 1*a*). The second "V" (when viewed in transverse cross-section, FIG. 1*b*) is formed by upward-sloping surfaces between the two outboard portions of the hull (sometimes referred to as "pontoons") and extending to the front and rear along the approximated longitudinal centerline of the vehicle. The sloped lateral surfaces of the first "V" direct detonation energy outward and away from the vehicle if an explosion occurs close to the side of the vehicle. The second, central "V" deals with detonations originating directly beneath the vehicle, between the pontoons, by directing the energy of the detonation forward and/or rearward to reduce the amount of kinetic energy transferred to the hull and its occupants.

SUMMARY

In a disclosed embodiment, a vehicle hull has a longitudinal blast mitigation duct between left and right hull portions. The duct comprises a first section oriented at a first angle to a longitudinal reference line, and a second section adjacent to the first section and oriented at a second angle to the reference line. The second angle is greater than the first angle to form a diverging surface for a shock wave travelling from the first to the second section.

In another embodiment, a rib projects generally perpendicular from a joint between the first and second sections. The rib is configured to initiate separation of the shock wave from the hull, thereby reducing the amount of energy transferred to the hull.

In another embodiment, the diverging surface formed by the first and second sections diverges toward a forward end of the hull, and the blast mitigation duct further comprises a two-section, rearward diverging surface for a shock wave travelling rearward along the hull.

In another embodiment, a vehicle hull comprises a left portion, a right portion, and a central portion between the left and right portions. The central portion is raised relative to the left and right portions to form a downward-opening duct having a first section oriented at first angle to a longitudinal reference line and a second section adjacent to the first section and oriented at a second angle to the reference line. The second angle is greater than the first angle to form a diverging surface.

In another embodiment, a vehicle hull comprises a first plate, a second plate attached to the first plate along a joint, and a rib attached to the first and second plates. The rib projects generally perpendicular from the second plate a distance sufficient to cause a shock wave to separate from the hull after passing the joint, thereby reducing energy transfer from the shock wave

BRIEF DESCRIPTION OF THE DRAWINGS

Embodiments of the present invention will now be described by way of example only with reference to the accompanying drawings in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As seen in FIGS. 2-5, a military vehicle 10 intended for use in a combat zone includes a blast-resistant hull 12 mounted to a frame 14. Suspension and powertrain components are schematically indicated at 16, and may include any number and combination of wheels and/or tracks (not shown). Hull 12 is depicted equipped with four crew seats such as may be the case if the hull forms a crew cab of a light general purpose vehicle, but a blast-resistant hull may be of any size necessary to house the required number of occupants and related mission equipment. Hull 12 may be formed of any appropriate high-strength material that provides the required degree of blast and ballistic protection for the occupants.

Terms such as up, down, horizontal, and vertical, as used herein, assume that vehicle 10 is in a normal running condition, with its wheels/tracks resting on a relatively flat and level surface. As such, this disclosure assumes that the longitudinal and lateral axes of vehicle 10 are generally parallel with the horizontal plane and the vertical axis of the vehicle is normal to the horizontal plane.

Figure 1A:
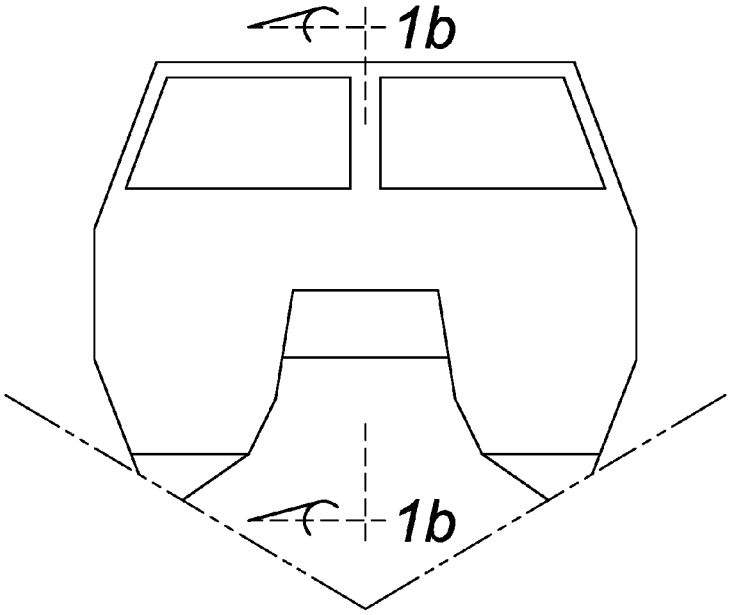
Figure 1a Prior Art
FIG. 1*a* is a transverse cross-section of a Double-V hull according to the prior art.
Figure 1B:
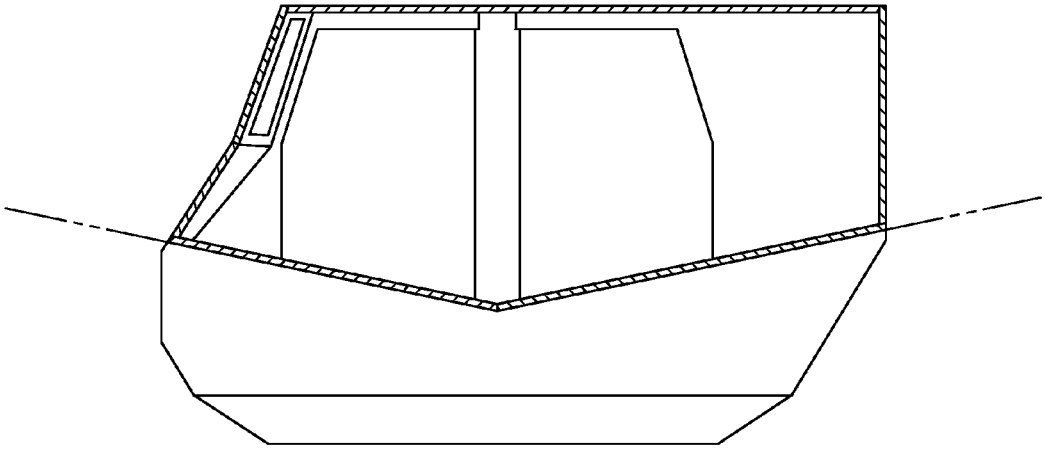
FIG. 1*b* is a longitudinal cross-section taken along line 1*b*-1*b* of FIG. 1.
Figure 2:
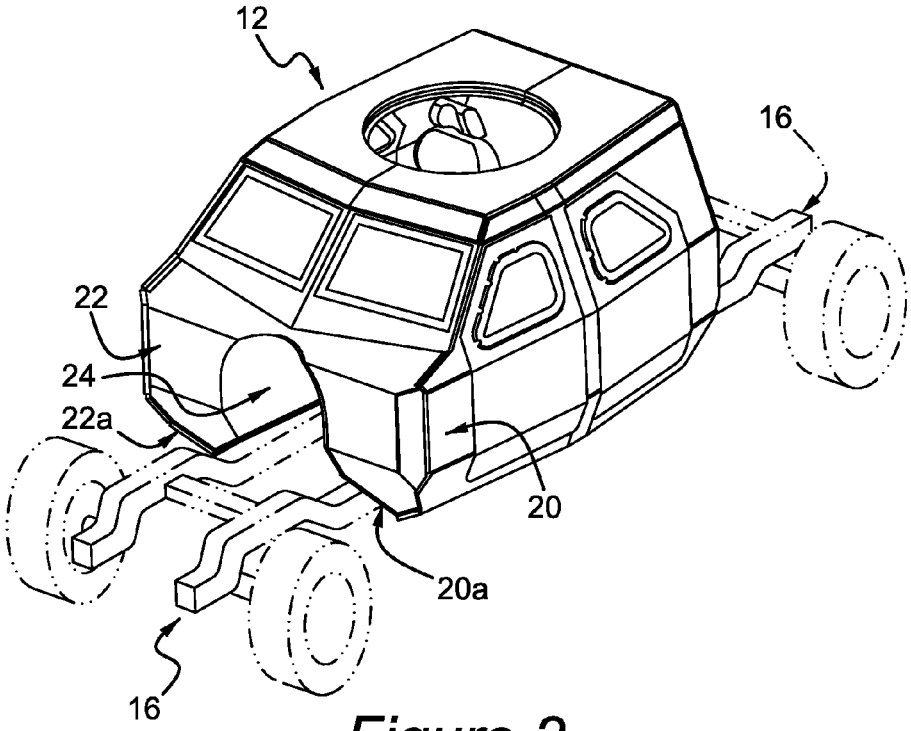
FIG. 2 is a schematic overall view of a military vehicle.
Figure 3:
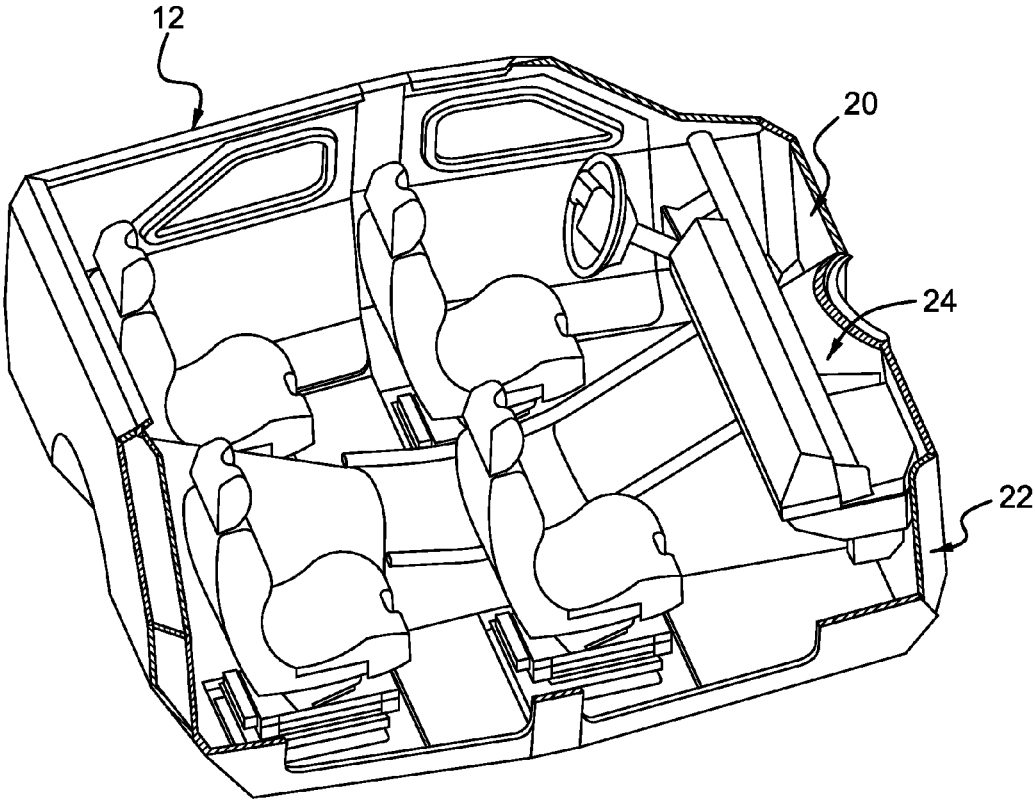
FIG. 3 is a cut-away view of the hull of the vehicle of FIG. 1.
Figure 4:
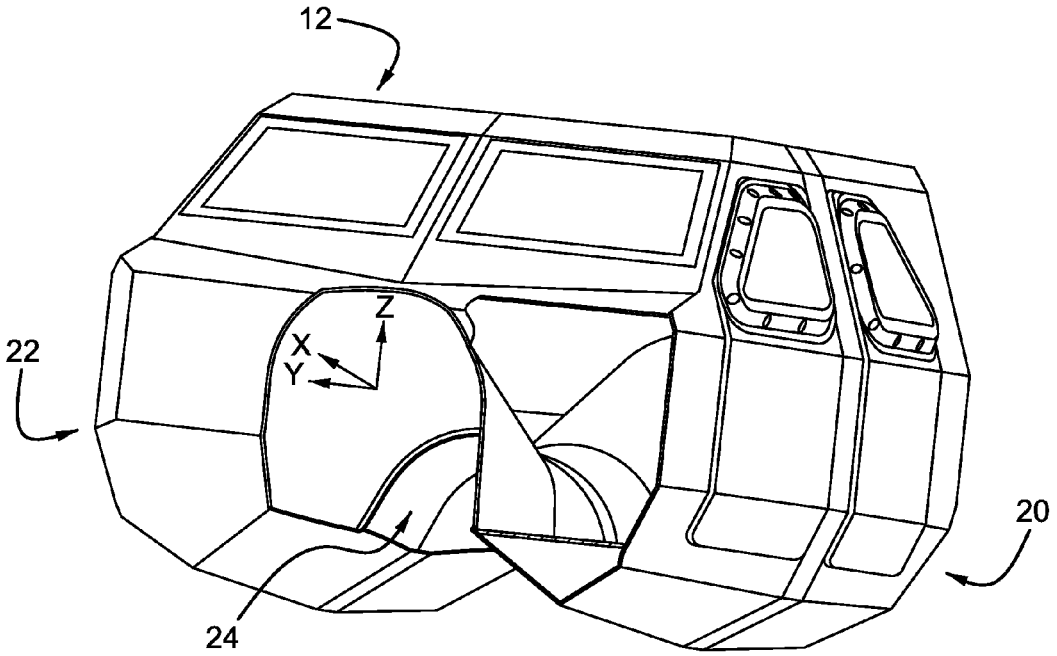
FIG. 4 is an front-quartering view of the exterior of the hull with a left front portion cut away to show inner surfaces of a blast mitigation duct.
Figure 5:
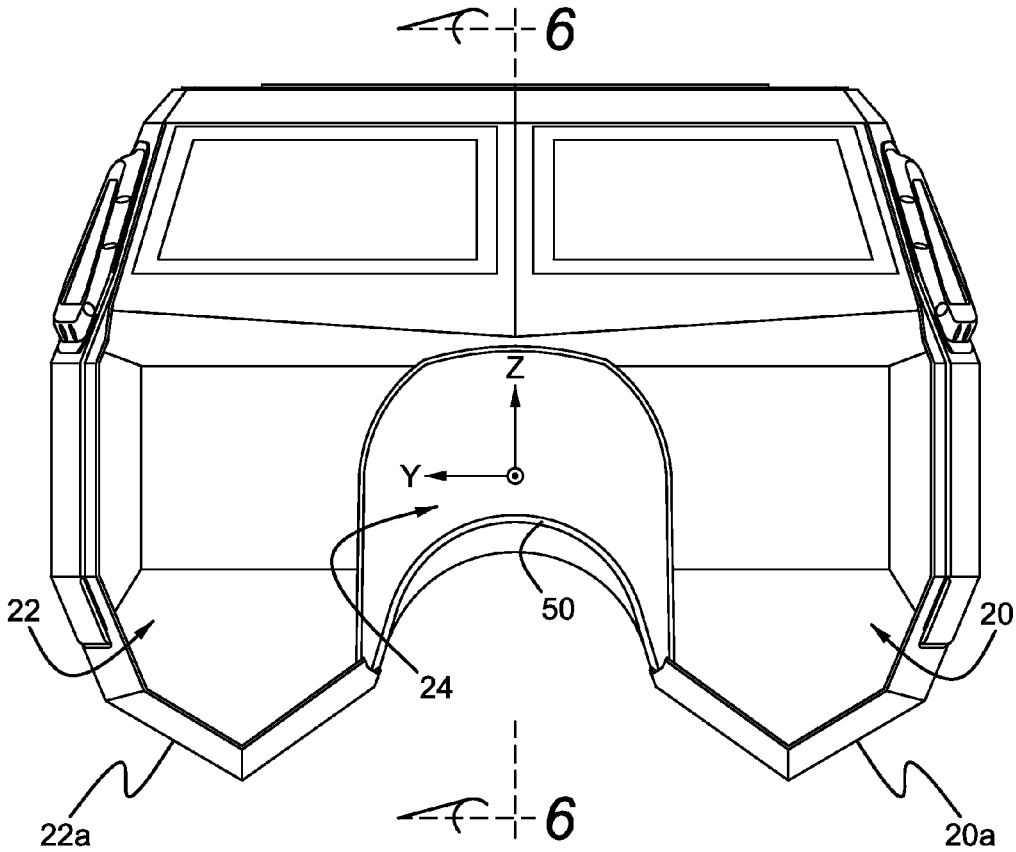
FIG. 5 is a front view of the hull.

The lower section of hull 12 generally comprises a left hull portion 20, a right hull portion 22, and a central hull portion 24 disposed between the left and right portions. Left and right hull portions 20, 22 may extend along substantially the full length of the vehicle and substantially parallel to the longitudinal centerline of the hull. As best seen in FIG. 5, left and right hull portions 20, 22 include outboard-facing lateral surfaces 20*a*, 22*a* that may be angled upward and outward in order to mitigate the effects of an explosion originating outboard of the vehicle. Depending upon the exact position of the detonation relative to the vehicle, the angled surfaces 20*a*, 22*a* (along with other features of the hull geometry) will reduce the amount of kinetic energy transferred to the hull from the detonation shock wave.

Figure 6:
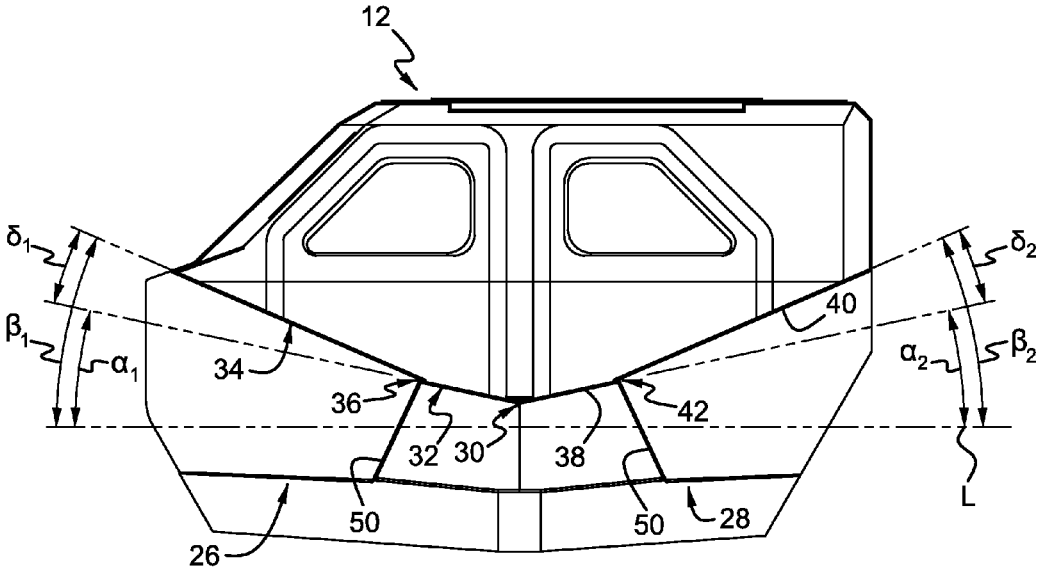
FIG. 6 is a cross-sectional view taken along line 6-6 of FIG. 5.
Figure 7:
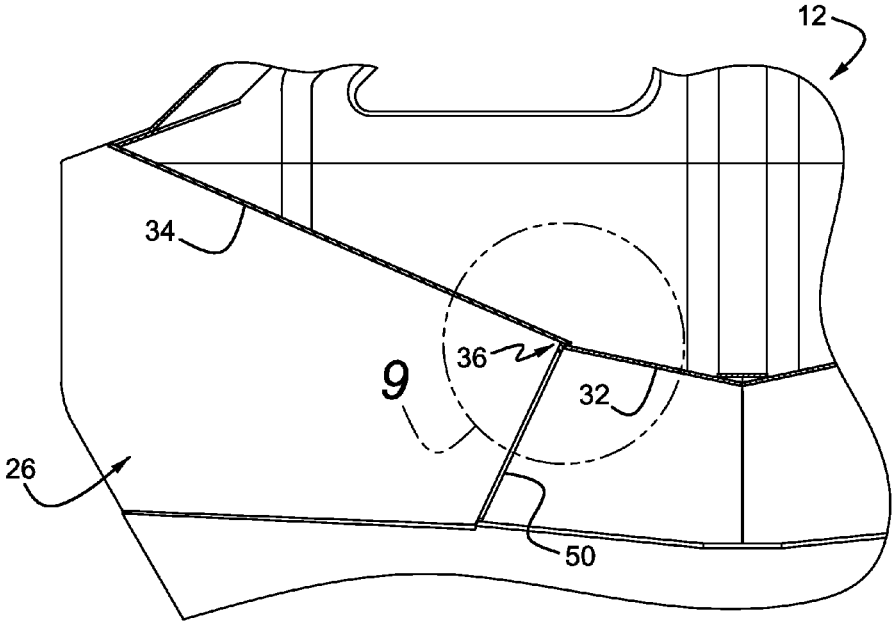
FIG. 7 is a detail view of the forward blast mitigation duct portion of FIG. 6.
Figure 8:
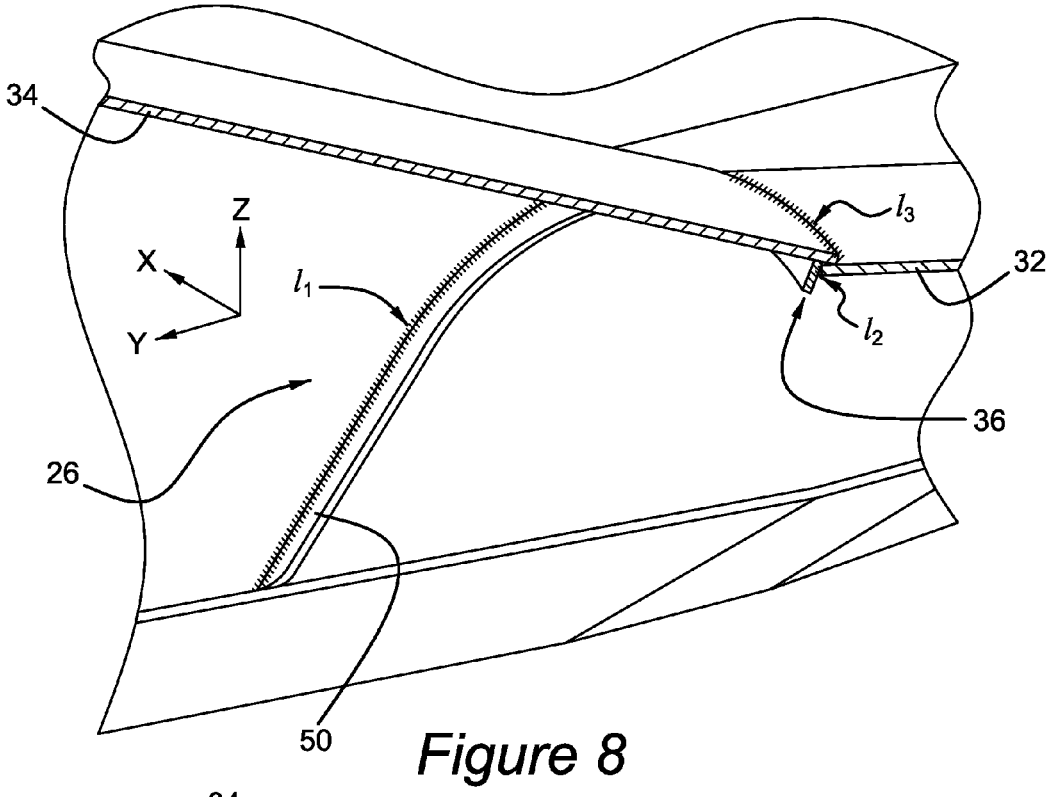
FIG. 8 is a perspective view of the forward blast mitigation duct shown in FIG. 7, viewed in a rearward-and-down direction.
Figure 9:
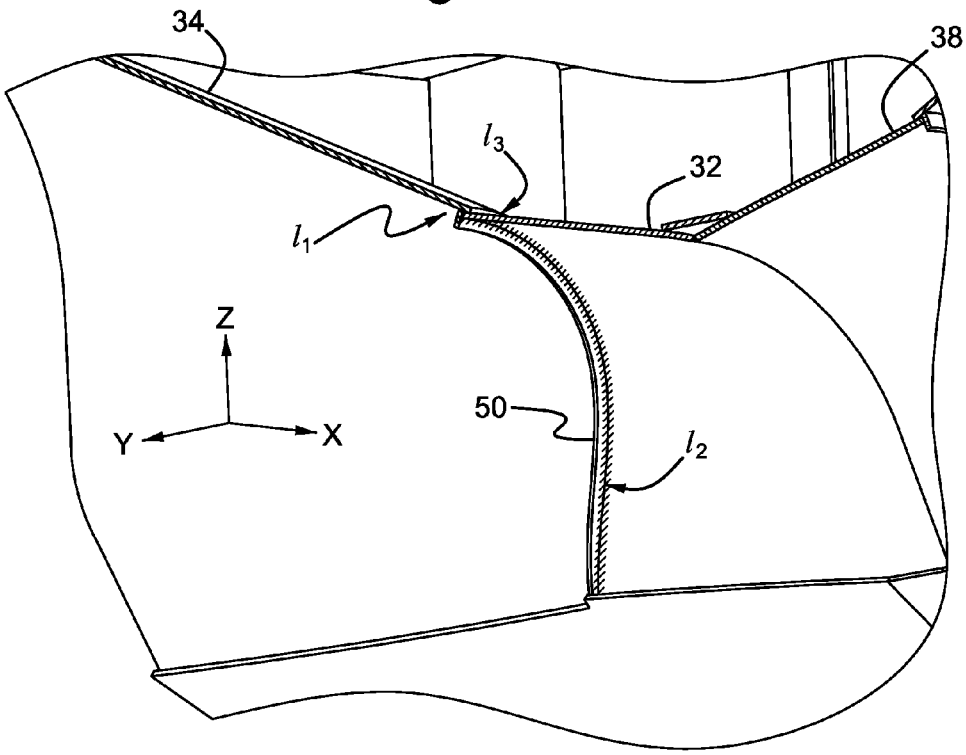
FIG. 9 is a perspective view of the forward blast mitigation duct shown in FIG. 8, viewed in a forward direction.
Figure 10:
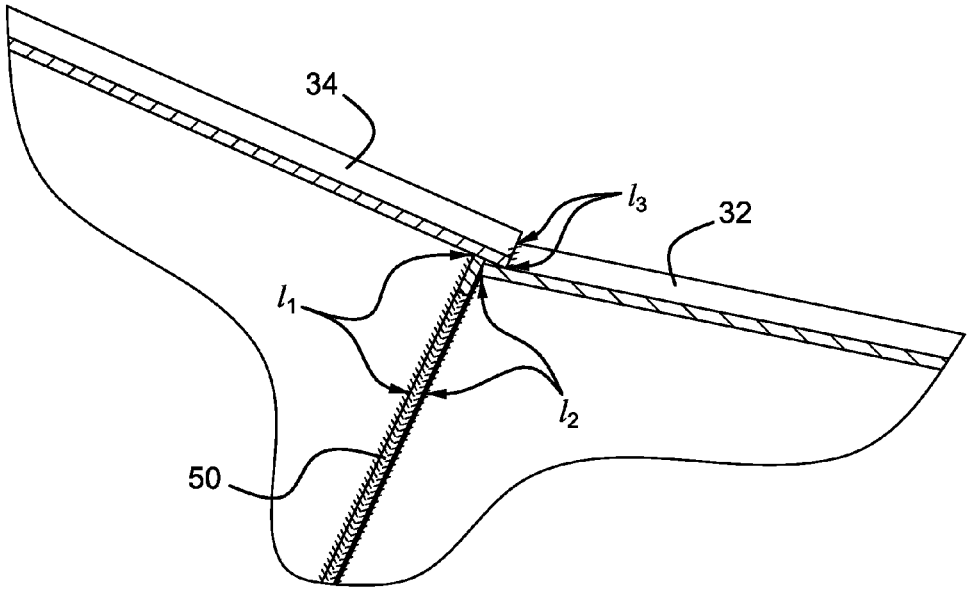
FIG. 10 is a further detail view of the convex corner area of the front blast mitigation duct, indicated by the circle 9 in FIG. 7.

As best seen in FIG. 6, the lower or exterior surfaces of central hull portion 24 are angled with respect to a reference line L to form a pair of blast mitigation ducts 26, 28. Duct 26 slopes upward and forward while duct 28 slopes upward and to the rear, the two ducts meeting at a vertex 30. Vertex 30 is shown located at the approximate longitudinal center of the hull 12, but the fore/aft location of the vertex may vary as dictated by mission requirements without departing from the scope of the present invention.

Forward blast mitigation duct 26 comprises a first duct section 32 extending forward from vertex 30 and sloping upward at an angle $\alpha_1$ from longitudinal reference line L (which in this view is horizontal), and a diverging duct section 34 joined to and extending forwardly from the first duct section. Diverging duct section 34 makes an angle $\beta_1$ with longitudinal centerline L as shown, and $\beta_1$ is greater than $\alpha_1$ so that a convex corner 36 having a divergence angle $\delta_1$ is formed at the intersection or joint between the two duct sections 32, 34.

Duct sections 32, 34 may be arched or curved to have downward-facing concave surfaces, as best seen in FIGS. 5 and 6. The forward edge of first duct section 32 and rear edge of diverging duct section 34 form may overlap one another along the joint between the two sections, thereby providing a joint having improved resistance to ballistic and blast effects of a detonation.

Rear blast mitigation duct 28 is generally similar in geometry to forward duct 26, comprising a first duct section 38 extending rearward from vertex 30 and sloping upward at an angle $\alpha_2$ from longitudinal reference line L, and a diverging duct section 40 joined to and extending rearward from the first duct section 38. Diverging duct section 40 makes an angle $\beta_2$ with reference line L as shown, and $\beta_2$ is greater than $\alpha_2$ so that a convex corner 42 having a divergence angle $\delta_2$ is formed at the intersection or joint between the two duct sections 38, 40.

Corresponding angles of forward and rear blast mitigation ducts 26, 28 ($\alpha_1/\alpha_2$, $\beta_1/\beta_2$, and $\delta_1/\delta_2$) may be equal or non-equal to one another depending upon design requirements and/or constraints (interior volume, for example) related to hull 12.

Front and rear blast mitigation ducts 26, 28 combine to form a downward-opening channel extending generally parallel with the longitudinal axis of hull 12. The channel may coincide with the vehicle centerline, or it may be offset from the centerline if vehicle design objectives so dictate. Components of the vehicle powertrain (drive shafts, transmissions, motors, batteries, etc.) or other essential equipment (not shown) may be located in the channel, but such components are not shown since they are incidental to this disclosure.

Detonation of an explosive device (such as mine or IED) generates a high-intensity wave front and related supersonic shock wave that radiates outward in all directions from the origin of the detonation. If the detonation origin is directly beneath hull 12 (between the left and right lower hull portions 20, 22), the energy of the detonation is directed against the surfaces of blast mitigation ducts 26, 28 and so is directed forward and/or rearward. The relative proportion of the energy of the detonation directed forward versus rearward depends on where relative to vertex 30 the detonation originates. For example, if the detonation origin is forward of the vertex 30, a larger portion of the detonation energy is directed forward (by forward blast mitigation duct 26) rather than to the rear.

Figure 11:
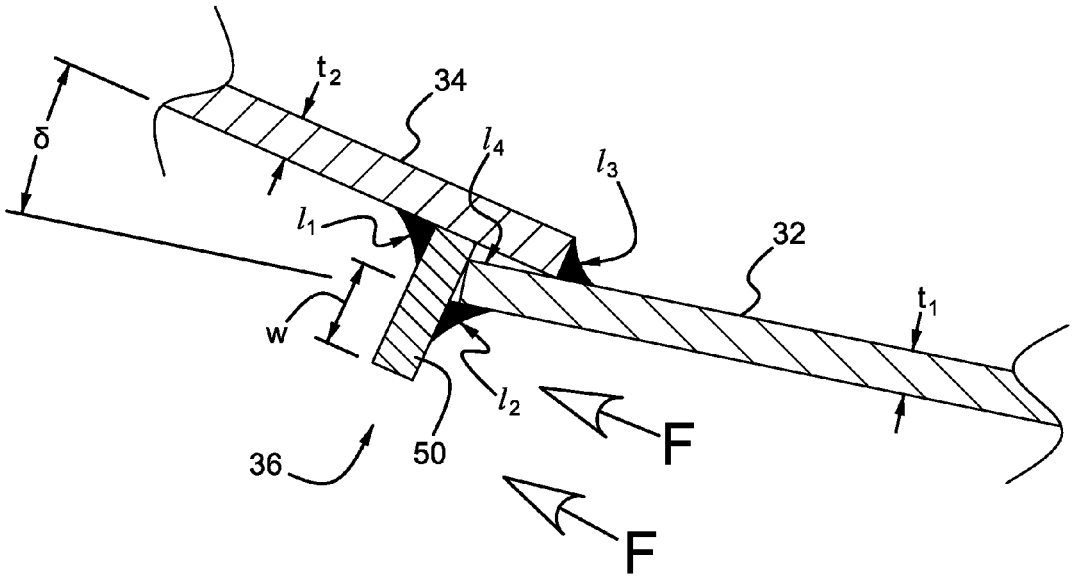
FIG. 11 is a schematic detail view of the convex corner of the front blast mitigation duct.

Referring now to FIG. 11, a schematic depiction of the interaction between the supersonic flow/shock wave and the surface of the forward blast mitigation duct 26. The direction of travel of the shock wave and related fluid flow being are by arrows F. As the shock wave travels past convex corner 36 at the joint between duct sections 32 and 34, the effect on the flow is similar to that occurring in a divergent nozzle and may be analyzed using the Prandtl-Meyer equation, as is well known in the in the fluid dynamics field. The Prandtl-Meyer equation predicts that a divergence angle $\delta$ greater than or equal to a critical value (known as the Prandtl-Meyer angle) will result in the shock wave separating from the surface and the formation of an expansion fan emanating from the corner of the diverging angle. Separation of the shock wave from the surface of the hull results in a reduced amount of kinetic energy being transferred to the hull structure as compared with the shock wave remaining attached to the surface.

The Prandtl-Meyer angle $\delta$ required to achieve shock wave separation depends upon many factors, including the speed of the shock wave (expressed in Mach number), which in turn depends upon the power of the explosive device and the distance of the detonation from the hull surface. Computer simulations have been run utilizing Mach numbers ranging from M=2.9 to M=5.2, with the corresponding δ values of between 11.1 degrees and 20.2 degrees effective to cause shock wave separation.

Figure 12:
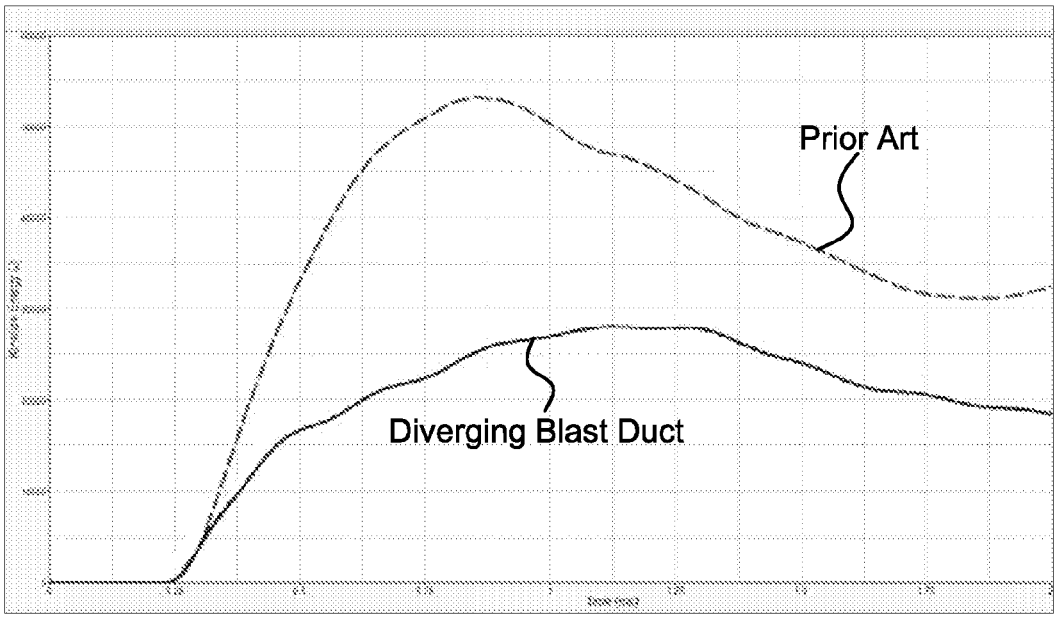
FIG. 12 is a graph showing results of computer simulations of kinetic energy transferred to different hull designs.

Simulations using computer models of hull designs featuring the diverging duct contour as described herein have resulted in significant reductions in the amount of kinetic energy transferred to the vehicle. This reduction is depicted in FIG. 12, where the upper, dashed-line shows the amount of kinetic energy transferred to a hull without the diverging duct effect (δ=0) whereas the lower, solid-line shows energy transferred to a hull featuring a diverging duct.

Figure 13A:
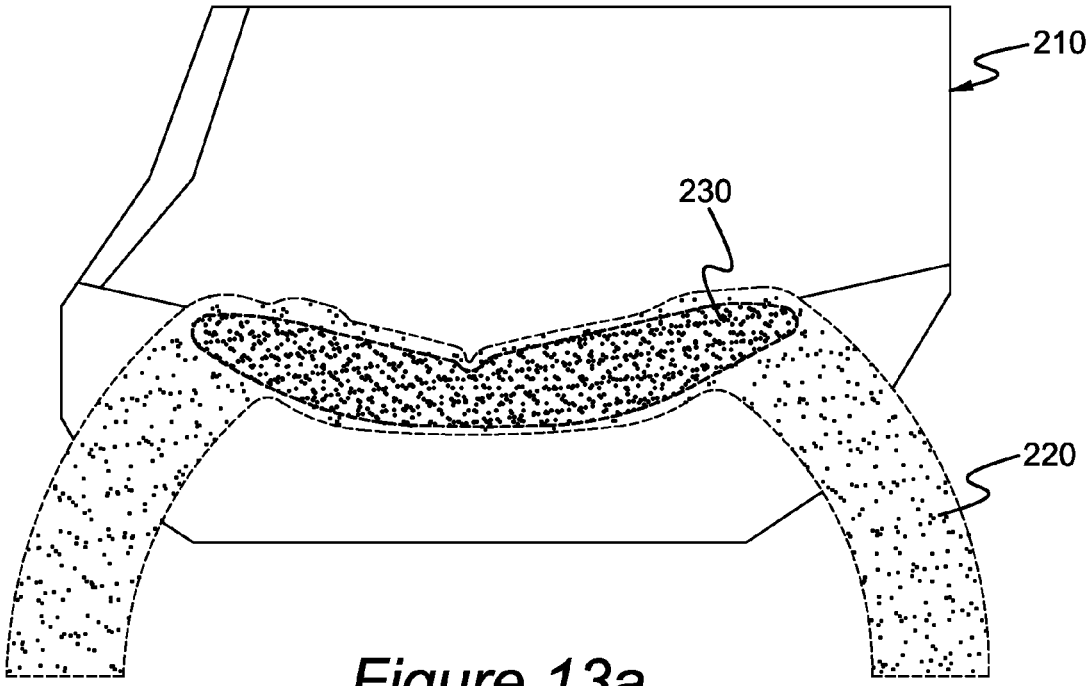
FIG. 13*a* is a graphic depiction of computer simulation results showing kinetic energy transfer to a prior art hull design.
Figure 13B:
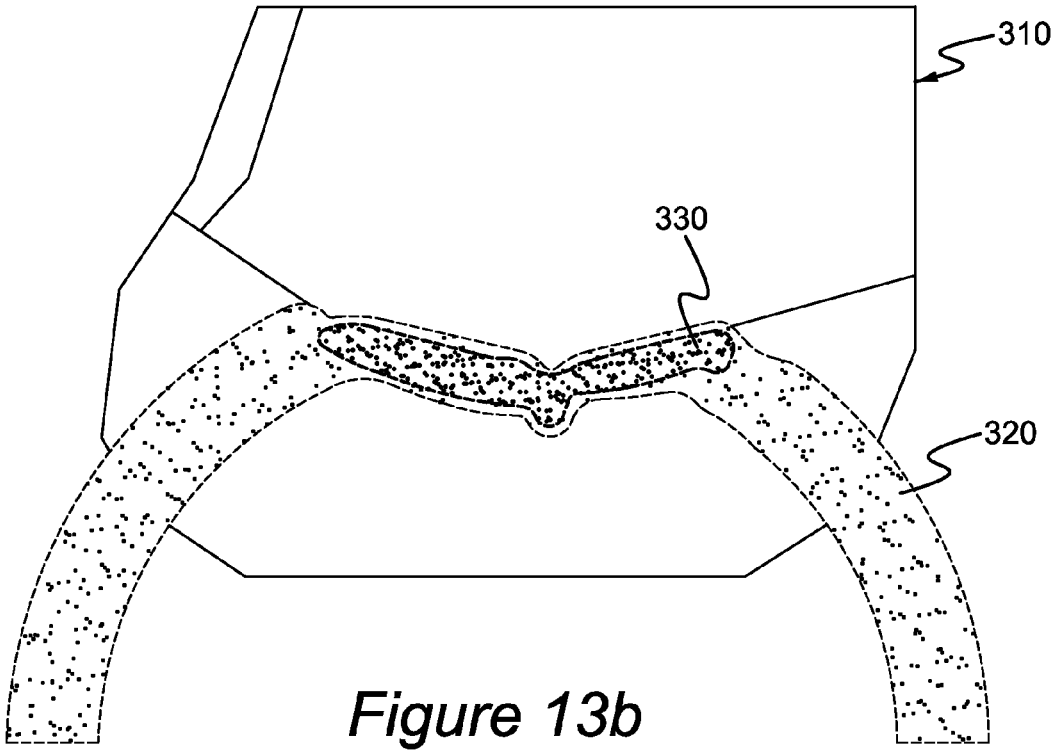
FIG. 13*b* is a graphic depiction of computer simulation results showing reduced kinetic energy transfer to a hull having design features as disclosed herein.

FIGS. 13*a* and 13*b* are graphic depictions of computer model simulations showing the reduction in the level of kinetic energy transferred from the detonation to the hull. FIG. 13*a* is a vehicle hull 210 having a prior art geometry (δ=0) being subjected to a detonation directly below the vehicle. Blast/shock wave 220 is shown striking the underside of hull 210, with the heavily stippled area 230 indicating the area over which the highest levels of kinetic energy transfer are predicted. FIG. 13*b* shows the results of the same detonation blast/shock wave 320 applied to a vehicle hull 310 having a diverging blast mitigation duct as disclosed herein. The significant reduction in energy transfer is clearly indicated by the reduced size of the area 330 of highest kinetic energy transfer.

A rib 50 (best seen in FIGS. 7-10) may extend along the joint between first duct section 32 and divergent duct section 34. In the disclosed embodiment, rib 50 is arch-shaped to follow the curved joint between the duct sections. A rib 50 may also be joined to rear duct sections 38, 40 at convex corner 42, and the following description of the forward rib 50 also applies to a rear rib if present.

Rib 50 has a width substantially greater than the thickness $t_1$ of first duct section 32 so that the lower edge 50*a* of the rib extends a distance w below the lower/outer surface of duct section 32. Rib 50 thus projects into the flow travelling from duct section 32 toward duct section 34 (indicated by arrows F). Computer simulations of detonations have shown that a rib 50 extending a significant distance beyond the surface of duct 32 enhances the desired separation of the shock wave as the wave transitions from first duct section 32 to divergent duct section 34.

For example, computer simulations have shown that a rib projection distance w ranging from approximately 5 mm (millimeters) to 19 mm enhances or initiates separation of the shock wave from the hull surface. A rib projection distance w=10 mm has, under simulated test conditions, shown a significant reduction in energy transferred to the vehicle.

The projecting rib 50 has the beneficial effect of achieving the desired shock wave separation when used in combination with a duct geometry in which divergence angle δ is smaller than would otherwise be required (per the discussion of the Prandtl-Meyer equation above) if the rib were not present. Rib 50 thus allows a hull design in which the advantageous effects of shock wave separation may be achieved using a smaller divergence angle δ, i.e. the angle $\beta_1$ of the divergent section 34 may be smaller/shallower, thereby increasing the amount of usable volume inside of hull 12.

Addition of rib 50 to the overlapping joint between duct sections 32 and 40 (as best seen in FIG. 11) also provides additional strength to the hull structure. Rib 50 and duct sections 32 and 34 may be joined by welding along one or more of the continuous lines of contact between the components, as indicated by $l_1$, $l_2$, and $l_3$. Multiple weld lines along the three lines of contact $l_1$, $l_2$, and $l_3$ increases the section modulus at the joint between the duct sections, making the joint very rigid and resistant to blast and ballistic effects of a detonation. An additional weld line $l_4$ may also be used at the location shown in FIG. 10 to further increase the strength of joint and/or to aid in the fabrication process.

The term "welding" is used herein to refer to any of the many joining techniques known in the materials field and is not meant to restrict the type of material used for the structure in any way. For example, components of the hull may be formed of high-strength aluminum alloy, as is well-known in the military vehicle industry. If such an alloy is used, the joints may be formed by friction stir welding, or some other suitable welding method. Full-penetration welds, where such welds are practical, generally provide superior strength. If non-metallic and/or metal-composite materials are used in the hull structure, other appropriate joining/bonding techniques such as adhesives and/or ultrasonic welding may be used.

Figure 14:
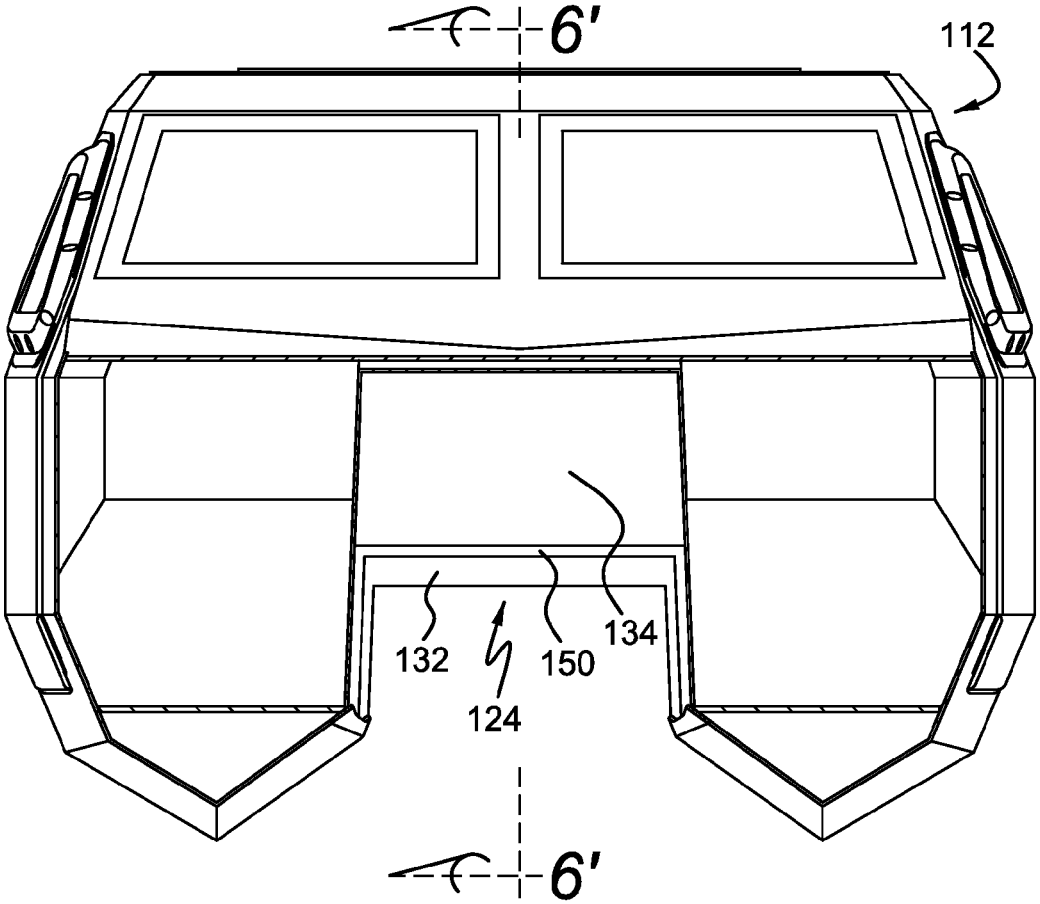
FIG. 14 is a schematic front view of another embodiment of a blast-resistant hull.

FIG. 14 shows another embodiment of a blast-resistant hull 112 in which the central hull portion 124 is formed by flat plates rather than the curved plates (32, 34, 38, 40) used in the embodiment shown in FIGS. 1-10. This configuration may be advantageous depending upon the material(s) and/or the construction methods used to construct the hull. First duct section 132 extends upward and forwardly to meet diverging duct section 134, and rib 150 extends along at least the horizontal line of the joint where the duct sections meet one another. Additional sections of rib 150 may also extend along the vertical portions of the joint between the duct sections. The rear diverging duct (not shown) may have a similar geometry and construction. It should be noted that a transverse cross-sectional view taken along line 6'-6' would appear substantially similar to FIG. 6, since the surfaces of duct sections 132, 134, are also arranged at angles α, β, and δ.

In summary, the diverging duct causes the shock wave from a detonation to separate from the vehicle hull surface, reducing or negating the ability of the shock wave to transfer kinetic energy to the structure. The rib protruding from the surface at or near the convex joint or corner further enhances/enables shock wave separation and the resulting reduction in kinetic energy transfer.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle hull having a longitudinal blast mitigation duct between left and right hull portions, the blast mitigation duct comprising:

a first section having a first edge adjacent to a longitudinal center of the hull and an opposite second edge relatively farther from the longitudinal center of the hull, the first section oriented at a first angle to a longitudinal reference line of the vehicle; and a second section having a first edge adjoining the second edge of the first section and extending toward one of a forward or a rear end of the hull, the second section oriented at a second angle to the reference line, the second angle greater than the first angle to form a diverging surface for a shock wave travelling from the first to the second section.

2. The hull of claim 1 further comprising:

a rib projecting generally perpendicular from a joint between the first and second sections, whereby the rib initiates separation of the shock wave from the hull.

3. The hull of claim 2 wherein the first and second sections overlap along the joint and the rib is attached to the first section along a first weld line and attached to the second section along a second weld line.

4. The hull of claim 1 wherein the diverging surface formed by the first and second sections has a diverging angle in the approximate range of from 10° to 20°.

5. The hull of claim 1 wherein the diverging surface formed by the first and second sections diverges toward the forward end of the hull and the blast mitigation duct further comprises:

a third section adjoining the first edge of the first section and extending toward the rear end of the hull, the third section oriented at third angle to the reference line; and a fourth section adjoining a second edge of the third section opposite from the first edge of the third section, the fourth section oriented at a fourth angle to the reference line, the fourth angle greater than the second angle to form a rearward diverging surface for a shock wave travelling from the third to the fourth section.

6. A vehicle hull comprising:

a left portion and a right portion; and a central portion between the left and right portions, the central portion raised relative to the left and right portions to form a concave-downward duct having:

a first section having a first edge adjacent to a longitudinal center of the hull and extending toward one of a forward end and a rear end of the hull and oriented at a first angle to a longitudinal reference line of the vehicle; and a second section having a first edge adjoining a second edge of the first section opposite the first edge of the first section and extending toward the one of the forward or the rear end of the hull, the second section oriented at a second angle to the reference line, the second angle greater than the first angle to form a diverging surface.

7. The hull of claim 6 wherein the duct further comprises a rib projecting generally perpendicular from a joint between the first and second sections, the rib projecting a distance sufficient to initiate separation of a shock wave travelling from the first section to the second section.

8. The hull of claim 7 wherein the rib is attached to the first section along a first weld line and attached to the second section along a second weld line.

9. The hull of claim 6 wherein the first and second sections comprise curved plates extending around the reference line.

10. The hull of claim 6 wherein the left and right portions have respective outward-facing surfaces angled relative to vertical.

11. The hull of claim 6 wherein the diverging surface formed by the first and second sections has a diverging angle in the approximate range of from 10° to 20°.

12. A vehicle hull comprising:

a left portion and a right portion; and a blast duct between the left and right portions, the blast duct including:

a forward diverging duct formed by a) a first surface having a rear edge adjacent to a longitudinal center of the hull and an opposite forward edge and b) a second surface having a rear edge joined to the forward edge of the first surface and extending forward therefrom, the first and second surfaces oriented at respective $1^{st}$ and $2^{nd}$ angles to horizontal, the $2^{nd}$ angle being steeper than the $1^{st}$ angle to form a diverging joint between the first and second surfaces; and a rear diverging duct formed by a) a third surface having a forward edge adjacent the rear edge of the first surface and an opposite rear edge and b) a fourth surface having a forward edge joined to the rear edge of the third surface and extending rearward therefrom, the third and fourth surfaces oriented at respective $3^{rd}$ and $4^{th}$ angles to horizontal, the $4^{th}$ angle being steeper than the $3^{rd}$ angle to form a diverging joint between the third and fourth surfaces.

13. The hull of claim 12 further comprising:

a rib extending along a joint between the first surface and the second surface, the rib projecting generally perpendicular from the joint a distance sufficient to cause a shock wave travelling from the first surface to the second surface to detach from the hull.

14. The hull of claim 12 wherein the first and second sections comprise curved surfaces extending around the reference line.

15. The hull of claim 12 wherein the left and right portions have respective outward-facing surfaces angled relative to vertical.

16. A vehicle hull comprising:

a left portion and a right portion; and a central portion between the left and right portions, the central portion raised relative to the left and right portions to form a downward-opening duct having:

a first section oriented at a first angle to a longitudinal reference line of the vehicle; and a second section adjacent to the first section and oriented at a second angle to the reference line, the second angle greater than the first angle to form a diverging surface; and a rib projecting generally perpendicular from a joint between the first and second sections, the rib projecting a distance sufficient to initiate separation of a shock wave travelling from the first section to the second section.

17. The hull of claim 16 wherein the rib is attached to the first section along a first weld line and attached to the second section along a second weld line.

* * * * *